US010787349B2

(12) United States Patent
Benz

(10) Patent No.: US 10,787,349 B2
(45) Date of Patent: Sep. 29, 2020

(54) LIFTING DEVICE

(71) Applicant: Gerhard Finkbeiner, Freudenstadt (DE)

(72) Inventor: Dieter Benz, Alpirsbach (DE)

(73) Assignee: Gerhard Finkbeiner, Freudenstadt (DE)

( * ) Notice: Subject to any disclaimer, the term of this patent is extended or adjusted under 35 U.S.C. 154(b) by 596 days.

(21) Appl. No.: 14/824,185

(22) Filed: Aug. 12, 2015

(65) Prior Publication Data

US 2016/0046470 A1 Feb. 18, 2016

(30) Foreign Application Priority Data

Aug. 14, 2014 (DE) ..... 20 2014 103 785 U

(51) Int. Cl.

*B66F 3/00* (2006.01)
*B66F 3/46* (2006.01)
*B66F 7/02* (2006.01)
*B66F 7/28* (2006.01)

(52) U.S. Cl.

CPC ..... *B66F 3/00* (2013.01); *B66F 3/46* (2013.01); *B66F 7/02* (2013.01); *B66F 7/28* (2013.01)

(58) Field of Classification Search

CPC ..... B66F 3/46; B66F 3/24; B66F 7/28; B66F 7/20; B66F 7/025; B66F 7/02
USPC ..... 187/210, 215, 216, 219, 217; 254/88, 254/89 H, 89 R; 33/203.12
See application file for complete search history.

(56) References Cited

U.S. PATENT DOCUMENTS 1,952,906 A * 3/1934 Bristol ..... B66F 7/18 187/217
2,569,982 A * 10/1951 Estel, Jr. ..... B66F 7/28 187/217
3,648,375 A * 3/1972 Wilkerson ..... G01B 5/255 248/279.1
4,084,790 A * 4/1978 Molnar ..... B66F 7/02 187/215
4,267,901 A * 5/1981 Tsujimura ..... B66F 7/00 187/204
4,825,977 A 5/1989 Isogai
5,031,726 A * 7/1991 Wakamiya ..... B66F 7/0675 187/204

(Continued)

FOREIGN PATENT DOCUMENTS

DE 80 24 326 U1 1/1981
FR 2489801 A3 3/1982

*Primary Examiner* — Orlando E Aviles
*Assistant Examiner* — Seahee Hong
(74) *Attorney, Agent, or Firm* — Renner, Otto, Boisselle & Sklar, LLP

(57) ABSTRACT

A lifting device, in particular for lifting and lowering loads, vehicles or similar, having a vertical lifting column, having a support arranged on the lifting column, which is guided by a guide on the lifting column and is able to be driven vertically along the lifting column, having a drive device for lifting and lowering the support and a load receiver arranged on the support, wherein the load receiver is able to be driven over and has a drive-on region, a support region and a drive-off region which are arranged in a row along a mutual axis in the drive-over direction and the load receiver has a holding arm outside of the support region and outside of the drive-over direction of the drive-on region or drive-off region.

18 Claims, 12 Drawing Sheets

(56) References Cited

U.S. PATENT DOCUMENTS 5,678,658 A * 10/1997 Wanner ..... B66F 7/28 187/219
6,209,209 B1 * 4/2001 Linson ..... G01B 5/255 33/203
6,845,848 B1 * 1/2005 Kritzer ..... B66F 7/28 187/213
7,869,018 B2 * 1/2011 Strege ..... B66F 7/28 356/139.09
8,162,107 B2 * 4/2012 Finkbeiner ..... B66F 7/28 187/237
8,313,086 B2 * 11/2012 Gray ..... B66F 3/24 254/134
8,567,761 B2 * 10/2013 De Jong ..... B66F 3/46 254/134
9,527,707 B1 * 12/2016 Fehringer ..... B66F 7/26
10,076,931 B2 * 9/2018 Finkbeiner ..... B60B 29/001
10,336,591 B1 * 7/2019 McLean ..... B66F 3/44
2005/0191145 A1 * 9/2005 Baker ..... B60P 3/06 410/30
2006/0143931 A1 * 7/2006 Jackson ..... G01B 11/2755 33/203.12
2009/0126208 A1 * 5/2009 Suita ..... G01M 17/0074 33/203.12
2009/0242333 A1 * 10/2009 Finkbeiner ..... B66F 3/46 187/209
2010/0051884 A1 * 3/2010 Matthews ..... B66F 7/28 254/45
2012/0080653 A1 * 4/2012 Gray ..... B66F 3/24 254/89 R
2015/0139764 A1 * 5/2015 Jang ..... B66F 7/12 414/458
2015/0202921 A1 * 7/2015 Finkbeiner ..... B66F 7/04 29/426.2
2015/0225213 A1 * 8/2015 Finkbeiner ..... B66F 3/46 414/800
2016/0002015 A1 * 1/2016 De Jong ..... B66F 3/46 29/426.2

* cited by examiner

LIFTING DEVICE

RELATED APPLICATION DATA

This application claims priority of German Patent Application No. 20 2014 103 785.3 filed Aug. 14, 2014, which is hereby incorporated herein by reference in its entirety.

FIELD OF INVENTION

The invention relates to a lifting device, in particular to lift and lower loads, vehicles or similar as well as lifting platforms consisting of lifting devices.

BACKGROUND

A column lifting platform, in particular a four-column lifting platform, for motor vehicles is known from DE 80 24 326 U1, in which each two lifting columns are arranged to lie opposite each other and a continuous drive rail to receive a vehicle is arranged on each two lifting columns which is able to be lifted and lowered by a lifting device.

This column lifting platform has the disadvantage that a vehicle which is situated on the lifting platform for maintenance or assembly purposes is not freely accessible from all sides. On the one hand, the continuous drive rails cover a part of the underbody of the vehicle and therefore an unhindered access for underbody work is made difficult, and on the other hand in the case of this lifting platform, the lifting columns are frequently situated in the region of the wheels of the vehicle, for which reason work on the wheels, the mudguards or also an opening of the doors is frequently not possible. Furthermore, the drive rails have a notable drive-on height, for which reason in the case of this embodiment, long drive-on ramps are necessary. Additionally, the drive rails are borne by two crossmembers such that an unhindered access to the work space under the vehicle is not possible.

A lifting device is known from U.S. Pat. No. 4,825,977, for which each two pivotable support arms are arranged on two lifting columns which lie opposite each other, wherein the support arms are pivoted to lift and lower a vehicle under the underbody of the vehicle and are positioned on holding devices on the vehicle which are provided therefor.

SUMMARY OF THE INVENTION

The aforesaid lifting device has the advantage of a good accessibility to the underbody of the lifted vehicle, but has the disadvantage that the pivotable support arms must be pivoted manually out of the vehicle region for driving the vehicle on and off the lifting device and must be positioned exactly on the holding devices of vehicle provided therefor for each vehicle. In particular, this is time-consuming during series inspection of vehicles.

The present invention provides a lifting device as well as a lifting platform to lift and lower loads, vehicles or similar, which has, on the one hand, an accessibility which is as great as possible to the vehicle for assembly, maintenance or repair work and, on the other hand, enables a quick lifting lowering of the vehicle.

An embodiment of the lifting device according to the invention comprises a vertical lifting column, on which a support is arranged, which is able to be driven vertically in a guide arranged on the lifting column. The lifting device is additionally equipped with a drive device, by means of which the support is able to be lifted and lowered. Additionally, a load receiver is arranged on the support which has a drive-on region, a support region and a drive-off region, which are arranged among a mutual axis in a drive-over direction. The load receiver comprises a holding arm, which is positioned outside of the support region and outside of the drive-over direction of the drive-on region or drive-off region. This load receiver can be provided to receive only one wheel or a twin wheel of a vehicle. This load receiver can also be positioned on a sill of a vehicle to lift the vehicle. Due to this embodiment of the load receiver, a vehicle can be driven onto the load receiver in a simple way and positioned thereon in order to subsequently enable a lifting. At the same time, due to the arrangement of the holding arm with respect to the load-bearing means outside of the support region, it is enabled that a good accessibility to the wheel or a twin wheel and the wheel housing of a vehicle is possible in order to implement work or inspections thereon.

In a preferred embodiment, the drive-on region, the support region, the drive-off region and the holding arm of the load receiver are designed to be planar, wherein the load receiver is produced, for example, from a metal sheet, such that a drive-on height onto the load receiver which is as low as possible is achieved. So that the load receiver produced from a sheet metal material achieves a sufficient strength to support a vehicle despite a low drive-on height, the metal sheet can have a thickness of preferably 5 to 50 mm. In order to achieve an increased strength of the planar load receiver, in an alternative embodiment, struts for stiffening can be attached to the lower side or the upper side of the planar load receiver. Preferably, a sandwich construction can also be provided in which several sheet metal layers of the same or different strengths are connected to one another and/or stiffening elements are provided between two metal sheets.

A further preferred embodiment provides that the drive-on region, the support region and the drive-off region has a receiving surface. This can be rectangular, quadratic, circular, semi-circular, oval, kidney-shaped, bone-shaped or in a similar formation. This formation enables a large support surface or a cover of the underbody of a vehicle standing on the load receiver which is as low as possible. Additionally, an accessibility to the work space under the vehicle from all four sides is provided.

In a particularly preferred embodiment, a longitudinal axis of the holding arm is arranged at an acute angle to the axis which crosses the drive-on region, the support region and the drive-off region of the load receiver. Therefore, the holding arm is guided as far as possible away from the support region of the load receiver, on which the wheel is supported, in order to increase the accessibility to the wheel.

An advantageous embodiment of the lifting device provides that an end of the holding arm is arranged on the support of the lifting column and the lifting column is arranged to be rotated in an angular position compared to the mutual axis along the drive-on region, the support region and the drive-off region of the load receiver. In this rotated position of the lifting column, the longitudinal axis of the holding arm is perpendicular to a front side of the lifting column, on which the guide of the lifting column, the support and the holding arm are arranged. In the case of a reception of a load by the lifting device, a force which is transferred to the lifting column by the support arm via the fastening device is therefore transferred perpendicularly to a front side of the lifting column and therefore perpendicularly to the guide of the lifting column, whereby a particularly high load reception of the lifting column is achieved.

Preferably the load receiver is provided for receiving only one wheel or one twin wheel. The lifting device comprises therefore a load receiver which is capable for receiving only one wheel or only one twin wheel. The load receiver is provided for example that for receiving a vehicle having two axles the wheels on a first axle and on a second axle each are provided on a separate load receiver each arranged on a lifting device.

The holding arm is formed, in a preferred embodiment, as a horizontally-orientated, planar holding arm and forms a unit with the planar load receiver. Therefore the holding arm and the receiving surface of the load receiver are designed as a flat, level element, whereby a low construction height is achieved. A particularly low drive-on height is thereby achieved with a load receiver in this embodiment. Furthermore, this construction method offers a substantially lower production outlay during the manufacture, as the support arm and the load receiver are produced as one element. Alternatively, the holding arm can be implemented as a separate component and can be connected to the load receiver.

For fastening the load receiver to the support, in a preferred embodiment, a fastening device is provided on the holding arm, said fastening device being formed in particular in the form of a flange element arranged vertically on the holding arm. The load receiver is connected to the support releasably by means of the flange connection. Alternatively, the fastening device can also be formed as a further alternative non-positive connection. The load receiver can also be connected firmly to the support.

In a preferred embodiment of the load receiver, a drive-on assistance is provided in the drive-on region of the load receiver, by means of which the vehicle is able to be driven onto the load receiver. This drive-on assistance can be implemented from a planar metal sheet which is mounted on the load receiver to be able to pivot and is able to be driven over during lifting of the load receiver from the floor autonomously into a securing position. In the securing position, for example, a striped section of the drive-on aid projects upwards compared to the load receiver in order to secure the wheel on the load receiver and to prevent an unintentional rolling back of the wheel from the load receiver.

The support region of the load receiver preferably has a recess to receive a rotating device which is able to be sealed with a removable cover which preferably aligns with the drive-on and drive-off region in a position which closes the recess. A load receiver can thereby be adapted in a simple manner to two different applications. If the cover to seal the recess remains arranged in the support region, this load receiver can be used for a non-steerable axle and a fixed receiver is provided. If the load receiver is used for a steerable axle, the cover can be removed and, for example, a rotary plate can be inserted into the recess such that a wheel standing thereon can be rotated by hand and a steering movement is able to be imitated in order to enable, for example, an improved accessibility for the wheel arch or to implement, for example, a functional inspection with regard to the steering axle.

The positioning of a rotatable plate as a rotational device in the support region in the recess has the advantage that a flat, step-free drive-over or a drive-over having only a low step is enabled.

Furthermore, it is preferably provided that positioning elements are provided on the load receiver to limit the support region which are formed as two longitudinal positioning sills which are able to be plugged in particular into the receiving surface of the load receiver. Vehicles having different axle spacings to one another can thereby be inspected on the same lifting platform. It only requires a change of the positioning of the positioning elements on the load receiver.

The load receiver preferably has an enlargeable support region along the axle, and also along the drive-over direction, which in particular is able to be enlarged telescopically. It is thereby enabled that the load receiver is able to be adapted to different axle spacings in a simple manner using the lifting devices which are firmly anchored into the ground. Alternatively it can also be provided that the load receiver having a fixed support region is formed to be larger or longer with regard to the longitudinal extension to the axle, than the load receiver which receives a rotatable support surface, such as, for example the rotary plate. A defined positioning of the vehicle having the front wheels is thereby provided by the load receiver having the rotatable support surface, whereas the further load receivers having the fixed support surface can receive vehicles having different axle spacings.

In a further preferred embodiment of the load receiver, the holding arm is provided for the formation of a left embodiment of the load receiver on a left side section of the drive-on or drive-off region. For the formation of a right embodiment of the load receiver, the holding arm is arranged on a right side section of the drive-on or drive-off region. Using the left and right embodiment of the load receiver, two mirror-inverted load receivers result which are arranged corresponding to the respective orientation of the holding arm on the support of the lifting device.

The invention also provides a lifting platform which comprises at least two or a pair of lifting devices which lie opposite each other, which are driven by a mutual control. This control can be connected by wire. Preferably a wireless control is provided. In particular a radio or Bluetooth communication is provided. For forming two-column lifting platform the vehicle can be lifted by positioning the load receiver in the sill-region of the vehicle.

A further preferred embodiment of the invention provides that, for the formation of a four-column or multi-column lifting platform a pair of lifting devices which lie opposite each other comprise a load receiver with a rotatable receiver which is provided in the support region and a further pair of lifting devices which lie opposite each other having a load receiver with a fixed receiver. Therefore, a securing of the position of the vehicle on the load receiver can occur using the load receiver having the fixed support via the positioning elements and the steerable wheels can be received in a simple manner by the load receiver having the rotatable receiver such that different steering positions can be adjusted without additional handling.

A preferred embodiment of the lifting platform provides that each pair of lifting devices which are allocated to each other, have a right and a left load receiver, such that the lifting devices stand opposite one another, crossways with regard to the orientation thereof. The lifting columns can thereby each be positioned in outer corner regions with respect to the work region, whereby a maximum accessibility of the work region is created.

A further alternative embodiment of the lifting platform provides that each pair of lifting devices which are allocated to each other is having only a right or left load receiver. Due to this the lifting columns which stand opposite one another are orientated in a point symmetry with respect to the working region.

A further alternative embodiment for the design of a four-column or multi-column lifting platform is provided in that the same load receiver is arranged on each of these lifting devices. Therein, the lifting columns allocated to one another in pairs, so the lifting columns allocated to an axle of the vehicle, are aligned mirror symmetrically to the longitudinal axis of a formed work space. A simplification in the production of the load receivers likewise enables the formation of such a four-column lifting platform.

BRIEF DESCRIPTION OF THE DRAWINGS

The invention as well as further advantageous embodiments and developments of the same are described and explained in more detail below by means of the examples depicted in the drawings. The features to be gleaned from the description and the drawings can be applied individually or together in any combination according to the invention. Herein are shown.

DETAILED DESCRIPTION

Figure 1:
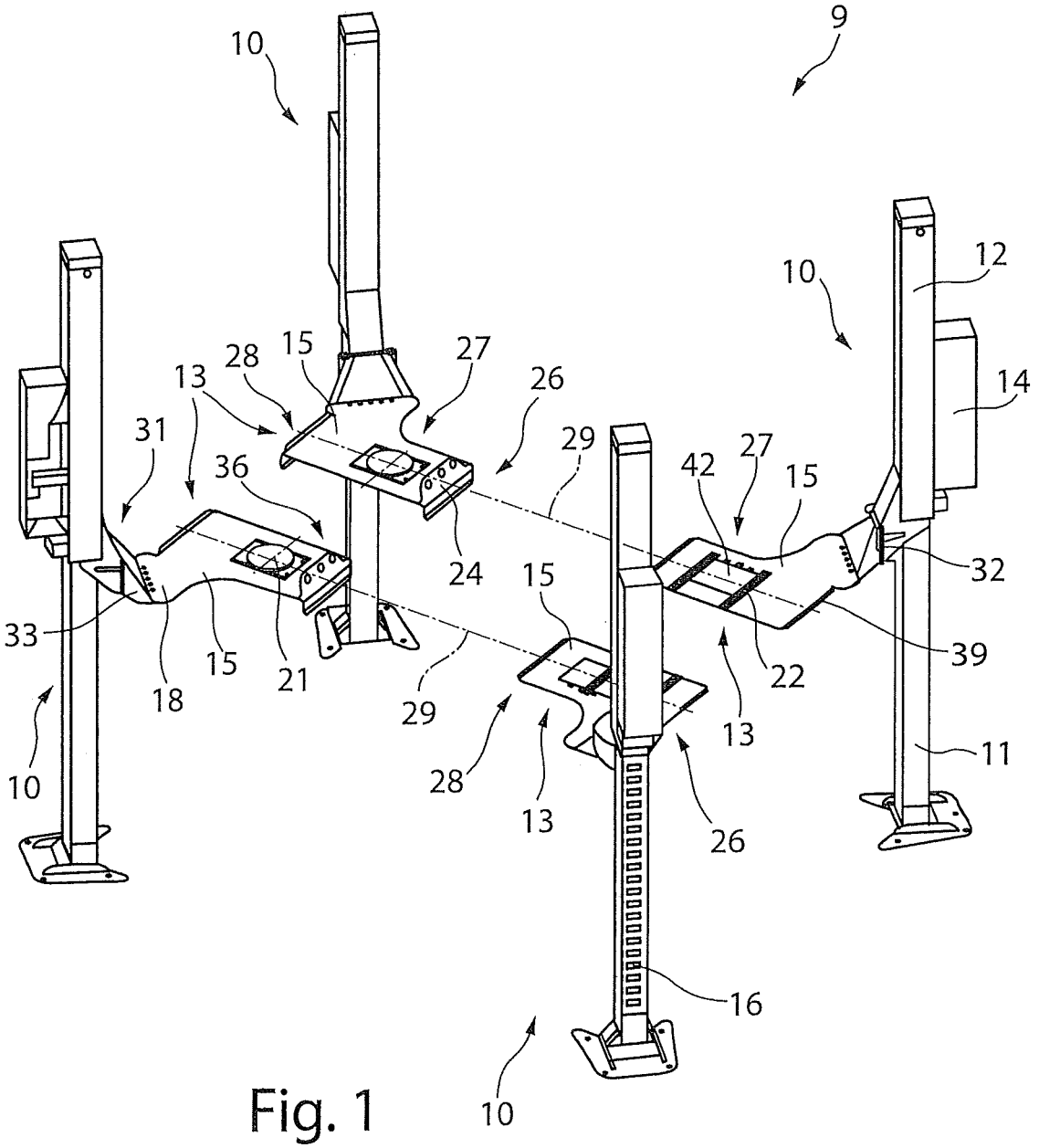
FIG. 1 a perspective view of a lifting platform having four lifting devices in the lifted state, FIG. 2 a top view onto the lifting platform in a lifted state according to FIG. 1, FIG. 3 a front view of the lifting platform in the lifted state according to FIG. 1, FIG. 4 a side view of the lifting platform in the lifted state according to FIG. 1, FIG. 5 a schematic sectional view along the line I-1 in FIG. 2, FIG. 6 a perspective detailed view of two lifting devices in the lowered state according to FIG. 1, FIG. 7 a perspective view of the lifting platform from above with a lifted vehicle, FIG. 8 a perspective view of the lifting platform from below according to FIG. 7, FIG. 9 a top view onto an alternative embodiment of a lifting platform according to FIG. 1, FIG. 10 a top view onto a further alternative embodiment of a lifting platform according to FIG. 1, FIG. 11 a top view onto a further alternative embodiment of a lifting platform according to FIG. 1 and FIG. 12 a perspective view onto an alternative embodiment of a lifting platform according to FIG. 1.

FIG. 1 shows a perspective view of a lifting platform 9 in which, for example, four lifting devices 10 are allocated to each other for the formation of a four-column lifting platform. A support 12 is arranged on the lifting column 11 of each lifting device 10. The support 12 is guided by a guide 16 and said support 12 is receiving a load receiver 13. A drive device 14 is provided on each support 12, by means of which the support 12 is able to be lifted and lowered vertically along the lifting column 11. The lifting devices 10 are arranged with respect to each other such that the load receivers 13 each receive a wheel or twin wheel, i.e. a dual wheel, of a vehicle and are able to be driven over by the vehicle.

The load receivers 13 comprise for example a planar, rectangular or quadratic receiving surfaces 15. A holding arm 18 is arranged in a corner region or lateral to each of the receiving surface 15 for connecting the load receiver 13 with the lifting column 11. The receiving surface 15 comprises a drive-on region 26, a support region 27 and a drive-off region 28, which extend along one axis 29. The lifting column 11 is orientated to be offset from the axis 29 of the load receiver 13. For the formation of a left embodiment of the load receiver 13, the holding arm 18 is arranged on a left side section of a drive-on region 26, and for the formation of a right embodiment of the load receiver 13, the holding arm 18 is arranged on a right side section of the drive-on region 26. The holding arm 18 is designed as a planar holding arm 18 according to the load receiver 13 and forms a mutual unit together with the load receiver 13.

A support region 27 is provided on a first pair of lifting devices 10 in a form of a fixed, in other words not rotatable region which lie opposite each other, said fixed support region 27 being limited by positioning elements 22 which hold a wheel or twin-wheel of the vehicle received by the lifting device 10 in a fixed position on the fixed support region 27 of the load receiver 13 and in particular is provided for a non-steerable wheel or a rear wheel of the vehicle. The positioning elements 22 are arranged transversely to the drive-over direction of the load receiver 13 and, for example, in parallel at a distance to one another. Preferably, position sills are used. The positioning element 22 is able to be arranged on the load receiver 13 in different positions or is able to be plugged into the load receiver 13. The fixed support region 27 can be formed by a continuous receiving surface 15. If a recess 43 is provided in the support region 27, the function of which is described below, this can be closed by a cover 42 and a continuous receiving surface 15 can be formed.

Drive-on chamfers 39 are provided on the load receivers 13, on which the fixed support region 27 is provided, in a drive-on region 26 and a drive-off region 28, which, for example, are formed by a trimming of an end region of the load receiver 13 in the drive-on region 26 or the drive-off region 28. (see FIG. 5)

Load receivers 13 are provided on a further pair of lifting devices 10 which stand opposite each other in pairs, which each receive a rotary device 21 in the support region 27, which is formed as a circular rotary plate, which is mounted to be rotatable around its own axis. According to a first embodiment, a recess 43 having a borehole 44 is arranged in a support region 27 of the load receiver 13, which is sealed to receive a rotary device 21 or by a cover 42. A steerable wheel positioned on the rotary device 21, for example a front wheel of the vehicle, is able to be steered from outside manually by hand with the aid of the rotary device 21 without the steering wheel of the vehicle having to be actuated. The rotary device 21 is arranged in the recess 43 in the support region 27 and is fixed therein to be rotatable. The rotary device 21 is preferably able to be removed from the recess 43 and closed by a cover 42.

A fastening device 31 is provided on the holding arm 18 of the load receiver 13, on which a flange element 32 which is preferably formed to be vertical is arranged. The load receiver 13 is connected releasably to the support 12 for example via a screw connection by means of the flange element 32. An angled stiffening element 33 is provided between the flange element 32 and the holding arm 18 which is arranged to be horizontal, said stiffening element 33, for example, being welded firmly to the holding arm 18 and to the flange element 32.

Figure 2:
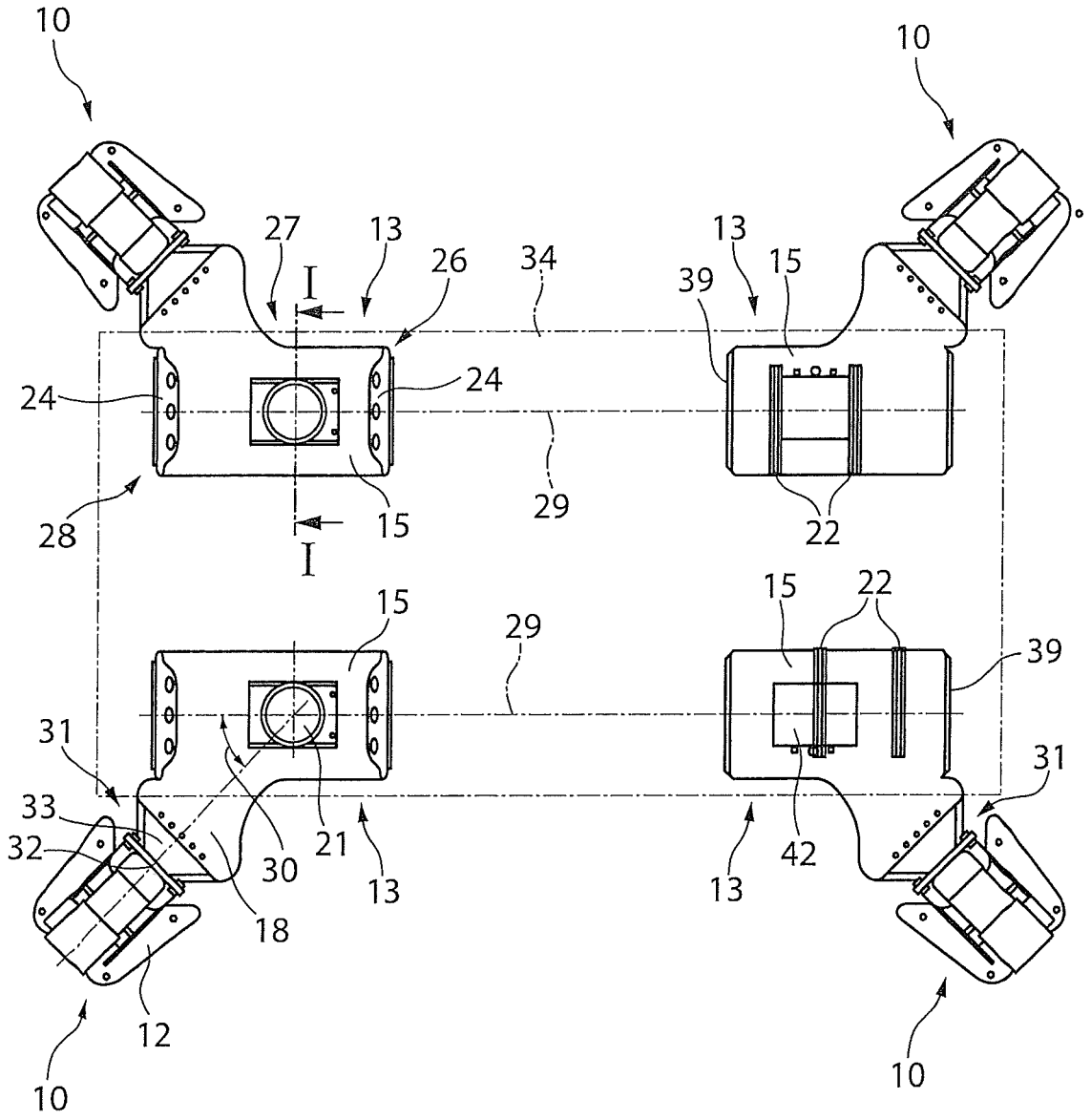

FIG. 2 shows a top view of the lifting platform 9 according to FIG. 1. The lifting devices 10 are orientated perpendicularly to a longitudinal axis of the holding arm 18 with their one front side of the lifting column 18, which are orientated at an acute angle 30 to the axis 29. The lifting column 11 and the support 12 is thereby positioned laterally offset to the support region 27 of the load receiver 13. Due to this lateral rotation, the four lifting devices 10 can stand opposite one another crossways.

The load receiver 13 which extends along the axis 29 is formed to be short, such that a free space which is as large as possible remains existing with respect to the second load receiver 13 which is likewise arranged in the same axis 29. The load receivers which lie opposite one another in pairs are positioned in such a way that these are adjusted on a track width of a vehicle to be inspected. A work space 34 is spanned by these four load receivers 13 which are allocated to each other, which is only limited in accessibility by surface regions which are formed by the drive-on region 26, the support region 27 and the drive-off region 28.

Positioning elements 22 can be able to be arranged on the load receiver 13 having a fixed support region 27, wherein for example two positioning elements 22 are provided adjacently directly on the cover 42, for example, on the upper load receiver 13. In the case of the lower load receiver 13, these are, for example, displaced to the right. Thus the adaptation to different axle spacings in relation to the rotational direction 21 is depicted.

Figure 3:
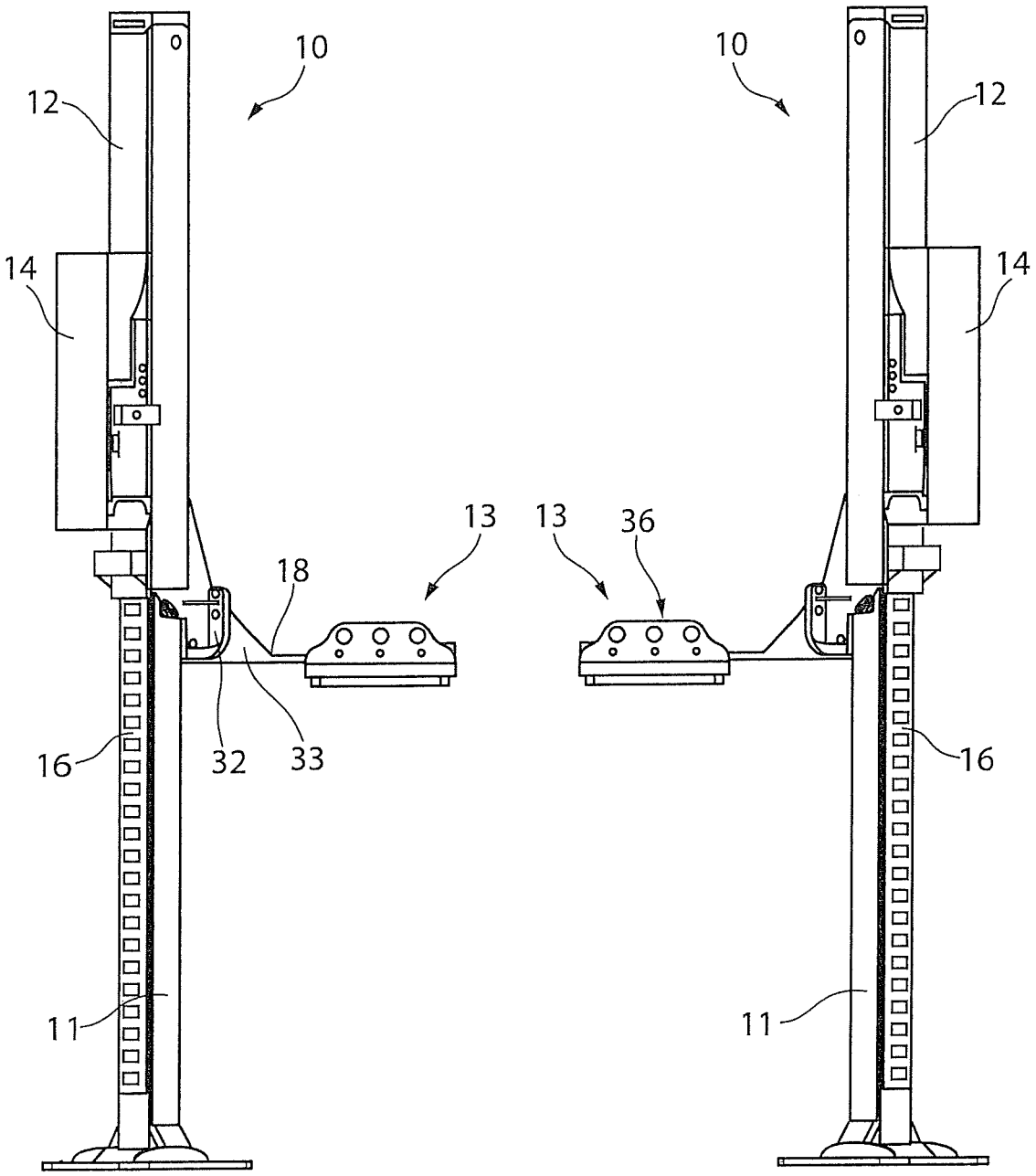

FIG. 3 shows a front view of the lifting platform 9 according to FIG. 1. In this position, the drive-on aids 24 of the load receivers 13 are arranged in a securing position 36 in which a wheel of the vehicle is secured on the load receiver 13.

Figure 4:
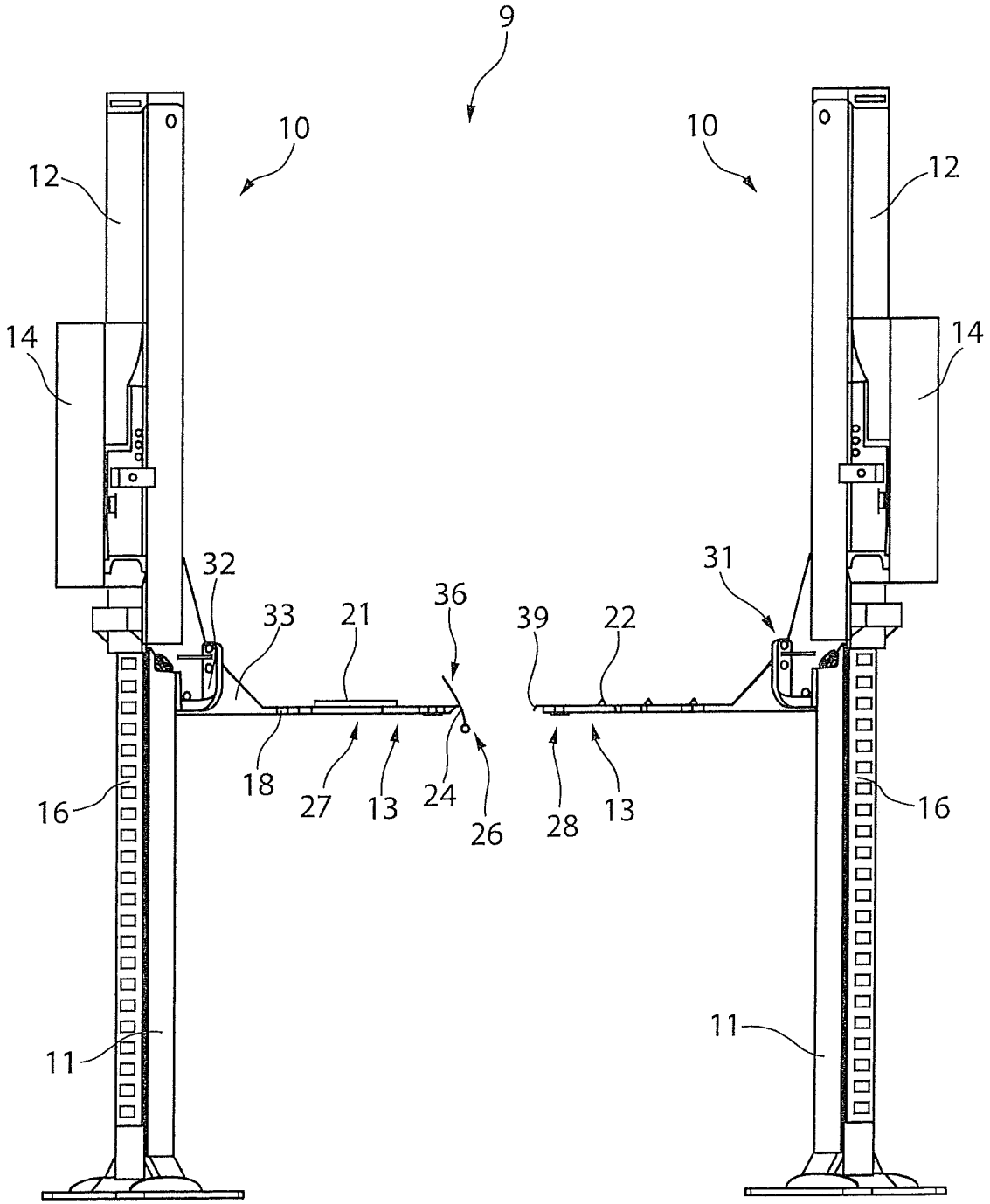

FIG. 4 shows a side view of the lifting platform 9 according to FIG. 1.

Figure 5:
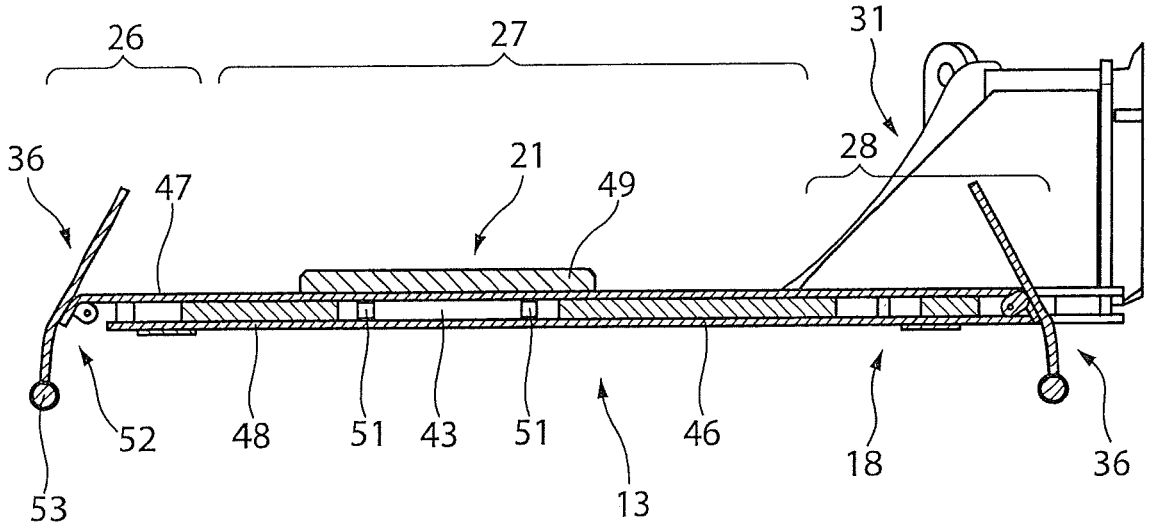

FIG. 5 shows a schematic sectional view along the line I-1 in FIG. 2. From this sectional view, for example, a construction of the load receiver 13 is depicted. The planar design of the receiving surface 15 and the holding arm 18 is, for example, formed by a sandwich construction which comprises a lower covering 46 as well as an upper covering 47 and a stiffening element 48 lying therebetween which is formed in the exemplary embodiment as a thick metal sheet. Alternatively, a type of frame or grid structure can be provided as a stiffening element 33. The coverings 46 and 47 are advantageously connected to the stiffening element 48 by welding. A recess 43 is provided in the load receiver 13 which extends though the upper covering 47 and the stiffening element 48. A cover 42 which is not depicted in more detail is provided for the formation of the fixed support region 27, said cover 42 being supported in the edge region on the stiffening element 48 and being aligned flush to the upper covering 47 such that a closed receiving surface 15 is created. The cover 42 is removed for the arrangement of the rotary device 21, as this is depicted in FIG. 5, and the rotary device 21 is inserted into the recess 43. For example, the rotary device 21 is formed by a rotary plate 49 which is supported on the stiffening element 48 with a shoulder. Therefore, a support of the load acting on the rotary plate 49 can occur. Guide elements 51 protrude into the recess 43, using which the rotary plate 49 is guided rotatably into the recess 43.

The drive-on aid 24 is arranged to be able to pivot in the drive-on region 26 and in the drive-off region 28. A securing position 36 is thereby assumed in a defined position in that a chamfer 52 is provided on the upper covering 47 respectively, onto which a section of the drive-on aid 24 abuts. The drive-on aid 24 is transferred into this securing position 36 in a lifted position of the load receiver due to the support element 53 which is at the same time a weight element.

The chamfer 52 in the upper covering 47 is likewise provided on the load receiver which is provided exclusively for a fixed support region 27.

Positioning elements 22 are provided to secure the vehicle instead of the drive-on aid 24. Using this chamfer 52, a simplified drive-on can be enabled.

This sectional depiction shows that the load receiver 13 is formed to be planar in the drive-on region 26, support region 27, drive-off region 28 and also the region of the holding arm 18, in particular is provided with the sandwich construction, on which the flange element 32 is arranged for the releasable fastening onto the support 12.

Figure 6:
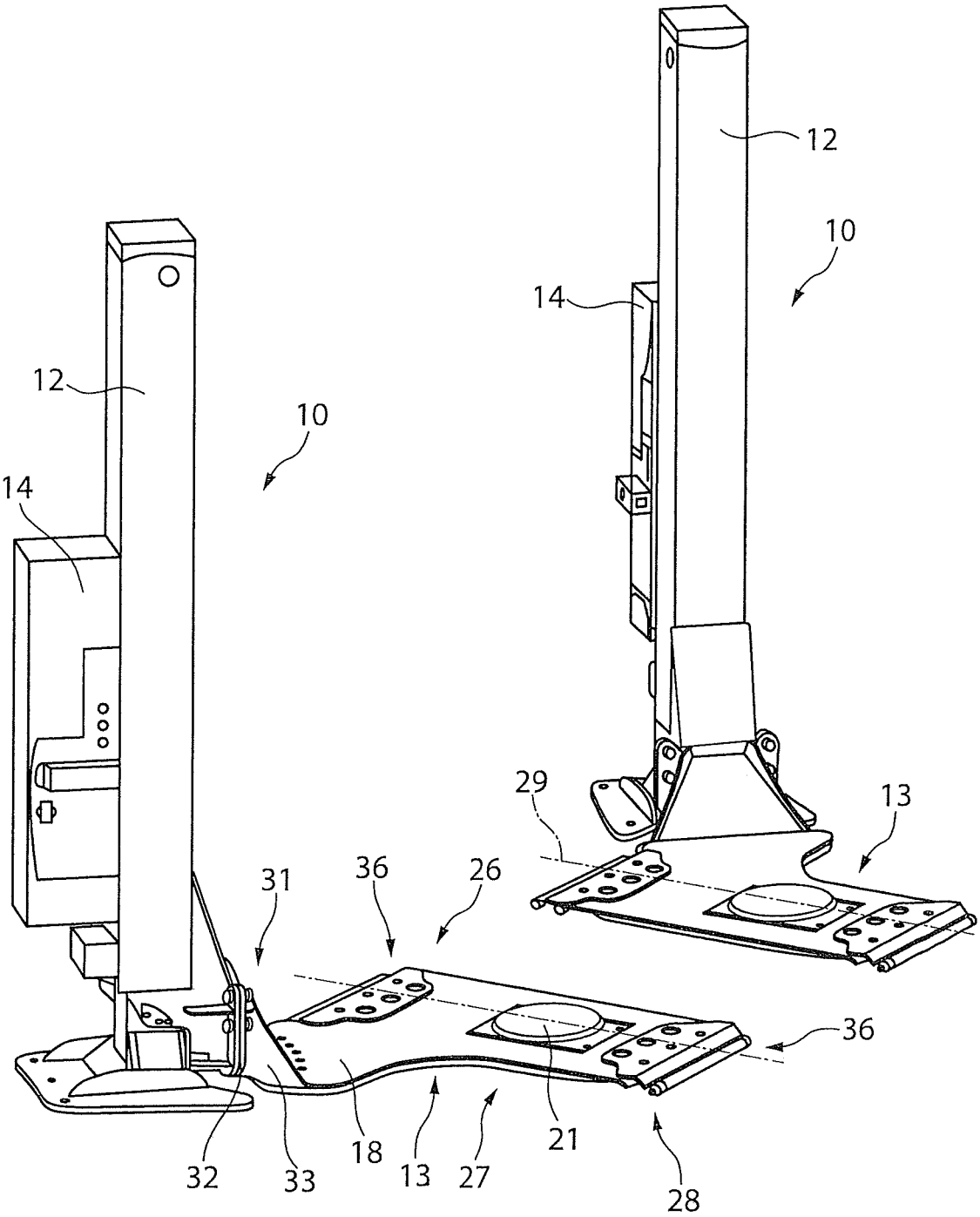

FIG. 6 shows a perspective detailed view of two lifting devices 10 according to FIG. 1, in which the supports 12 abut onto the floor in a lowered position. In this lowered position, the pivotable drive-on aids 24 are transferred into a drive-on position 41 in which the load receivers 13 are able to be driven over with the vehicle. Additionally, the load receivers 13 having the planar holding arm 18 do not represent an obstacle during assembly and maintenance work around the vehicle due to the low construction height and flat extension up to the flange position.

Figure 7:
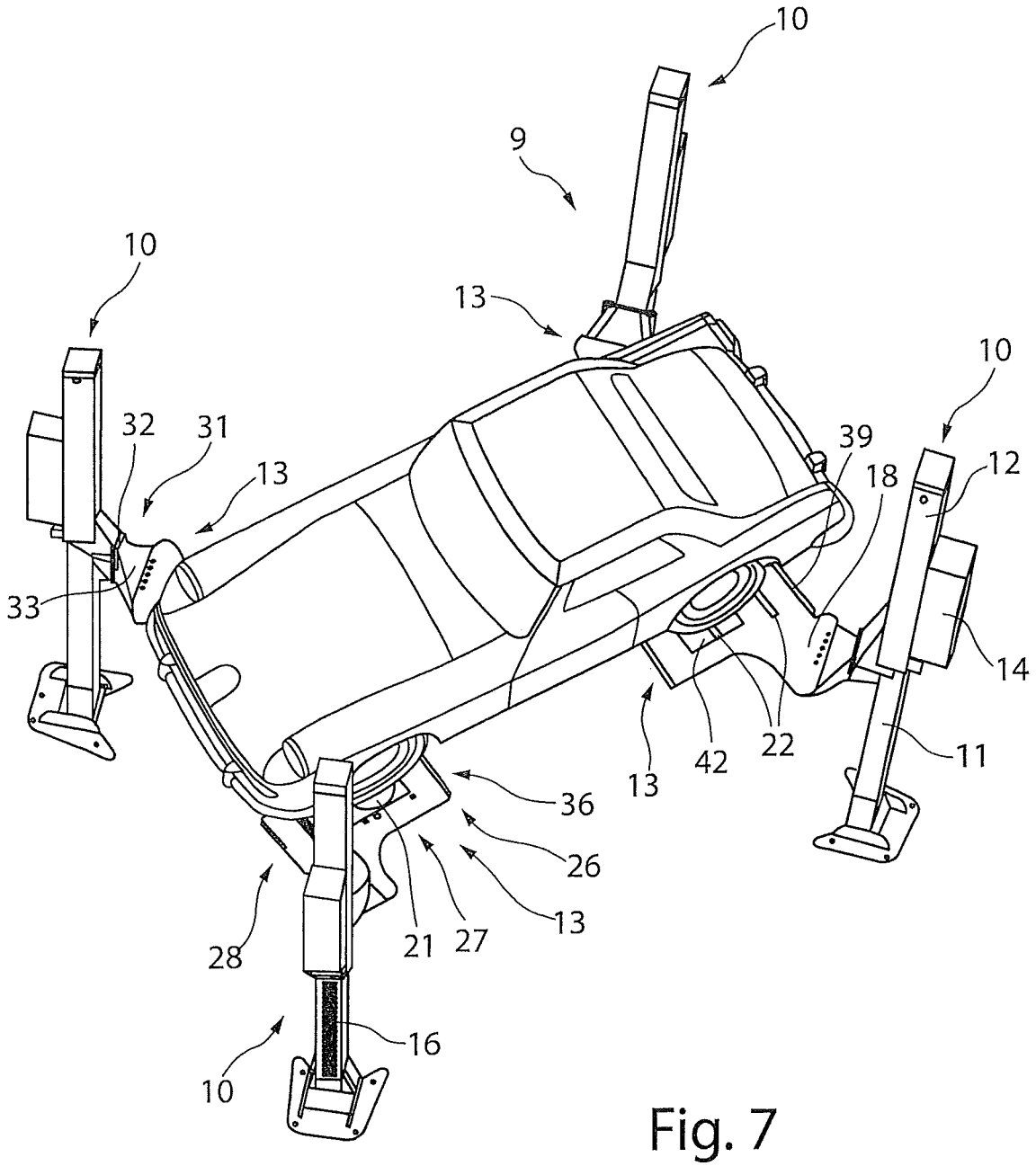

FIG. 7 shows a perspective view of the lifting platform 9 from above, in which a vehicle is positioned on the lifting devices 10 in the lifted state. The wheels of the vehicle are located on the support regions 27 of the load receivers 13, wherein the front wheels of the vehicle are positioned on the rotary devices 21 in the support region 27 and the rear wheels of the vehicle are positioned on the fixed support region 27. The rear wheels are thereby held in a fixed position by the positioning elements 22.

Due to the arrangement and the length of the holding arms 18, additionally a free work region is formed between the lifting columns 11 and the vehicle arranged on the load receivers 13 which offers an optimum accessibility in particular in the region of the wheel arches and the mudguards.

Figure 8:
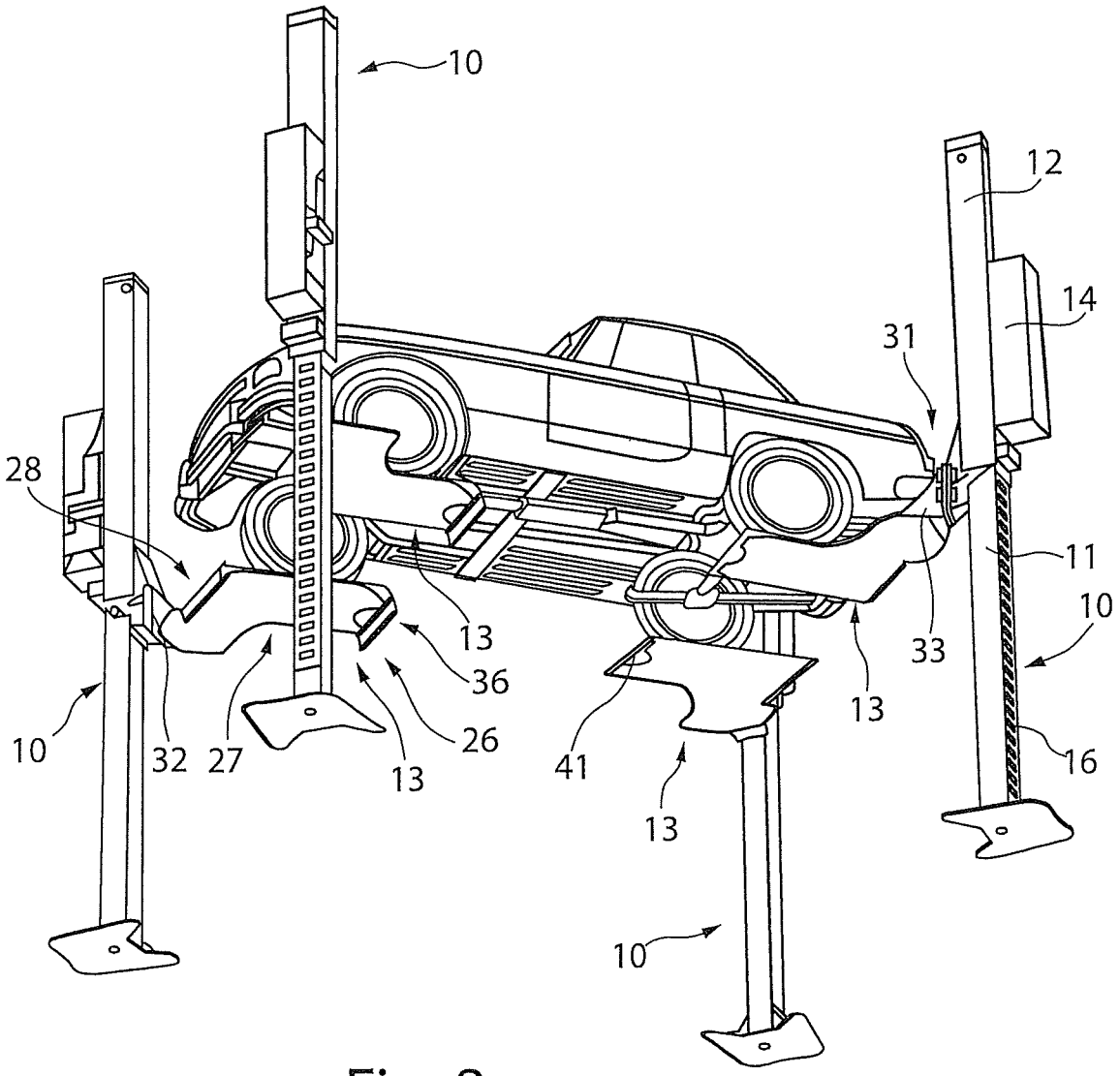

FIG. 8 shows a perspective view of the lifting platform 9 according to FIG. 7 from below. From this image it is clear that only a minimum region of the underbody of the vehicle is covered by the load receivers 13, whereby an accessibility which is as large as possible to the lower side of the vehicle is provided.

Figure 9:
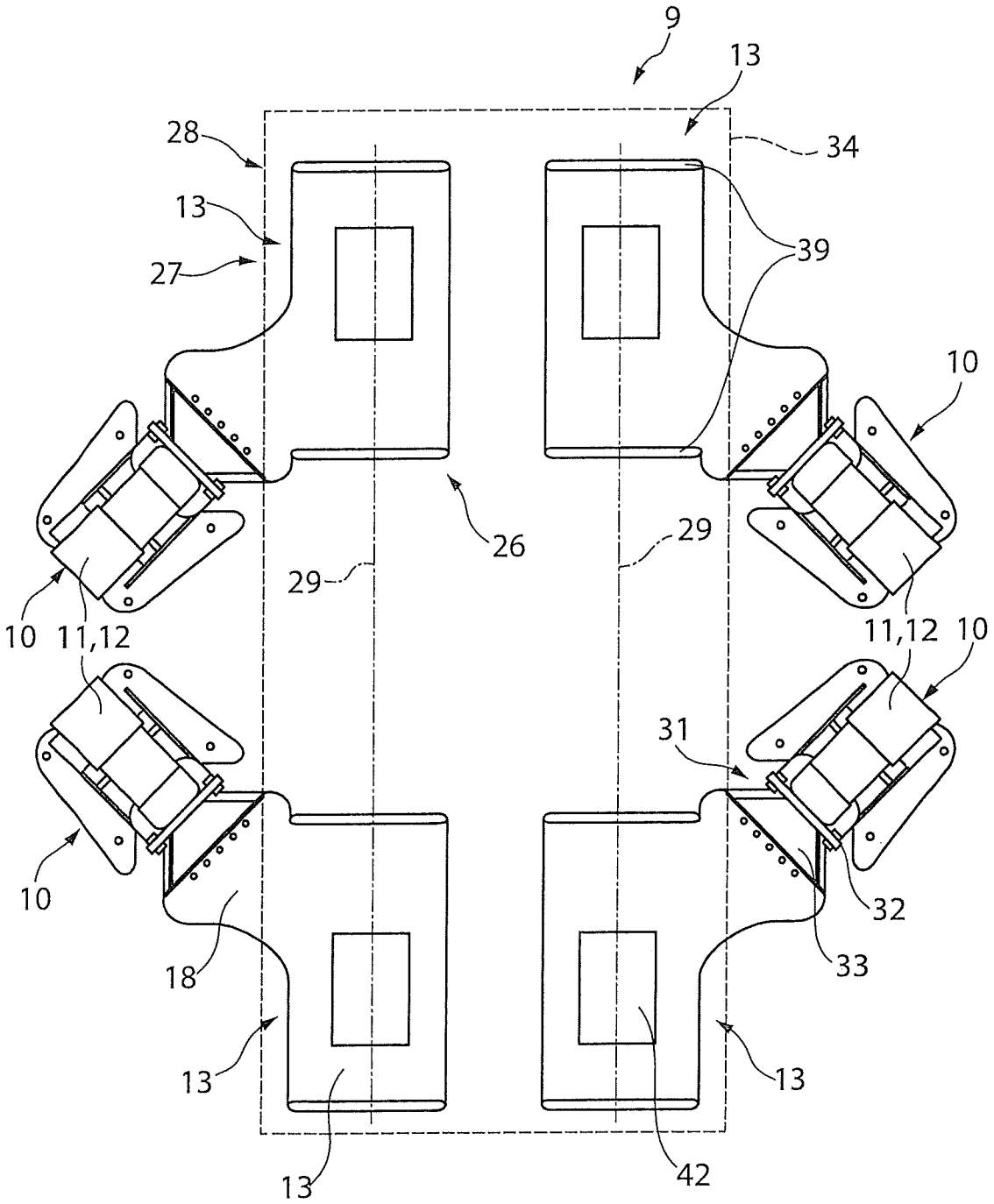

FIG. 9 shows a top view onto a lifting platform 9 in an alternative arrangement to FIG. 2, in which the pair of the lifting devices 10 having the fixed support region 27 and the pair of lifting devices having the rotary device 21 in the support region 27 according to FIG. 2 are exchanged with each other such that the lifting columns 11 and the supports 12 or the lifting devices 10 form a type of O-shaped arrangement.

Figure 10:
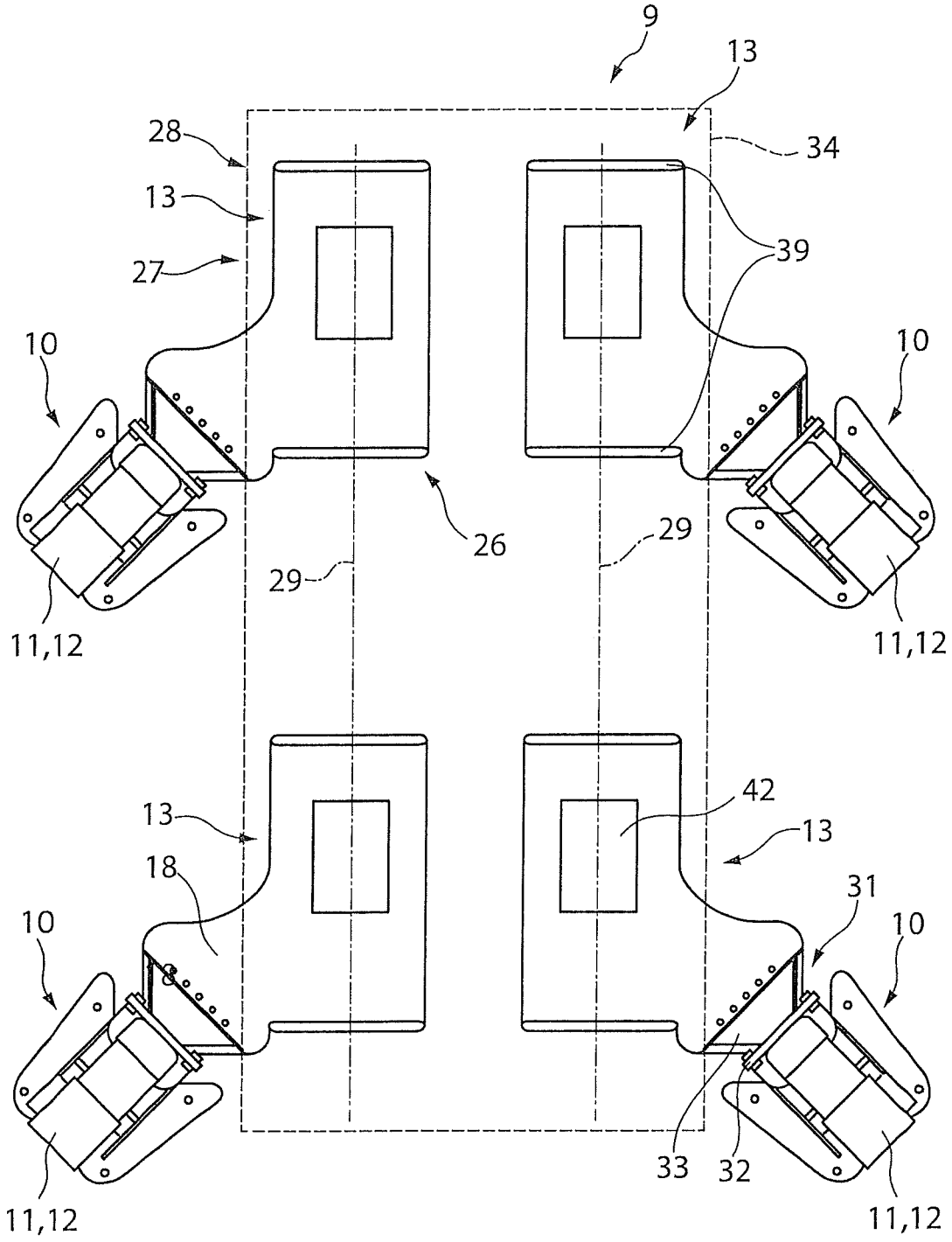

FIG. 10 shows a top view onto a lifting platform 9 in a further alternative arrangement of the lifting devices 10 to FIG. 2, in which two identically-orientated load receivers 13 are each arranged in an axis 29. Therein two left load receiver 13 are arranged on each of the lifting devices 10 of the one side and two right load receivers 13 are arranged on each of the two lifting columns 11 on the side which lies opposite. Accordingly, the lifting columns 11 and supports 12 of the lifting devices 10 are also aligned identically along an axis 29 and the lifting columns 11 and supports 12 are formed on the axis 29 which lies opposite, mirror-inverted to a central axis of the work space 34 lying therebetween.

Figure 11:
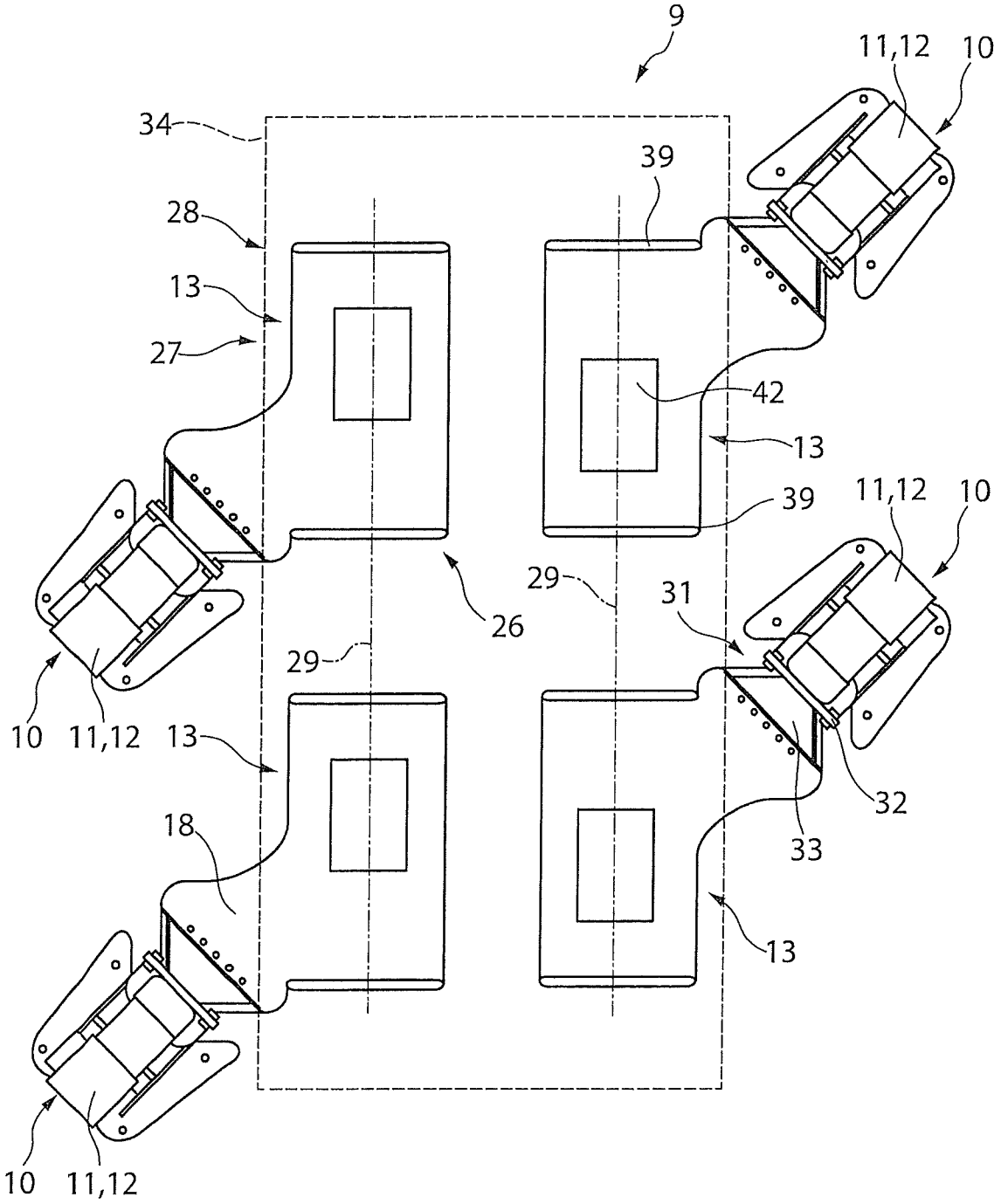

FIG. 11 shows a top view onto a lifting platform 9 in a further alternative arrangement to FIG. 2, in which an identically-orientated load receiver 13, so for example a left or a right embodiment of the load receiver 13, is arranged on each support 12 of the lifting device 10 respectively. In the case of this arrangement, a pair of lifting devices 10 which is allocated to an axle of the vehicle is directed symmetrically to the work space 34.

Figure 12:
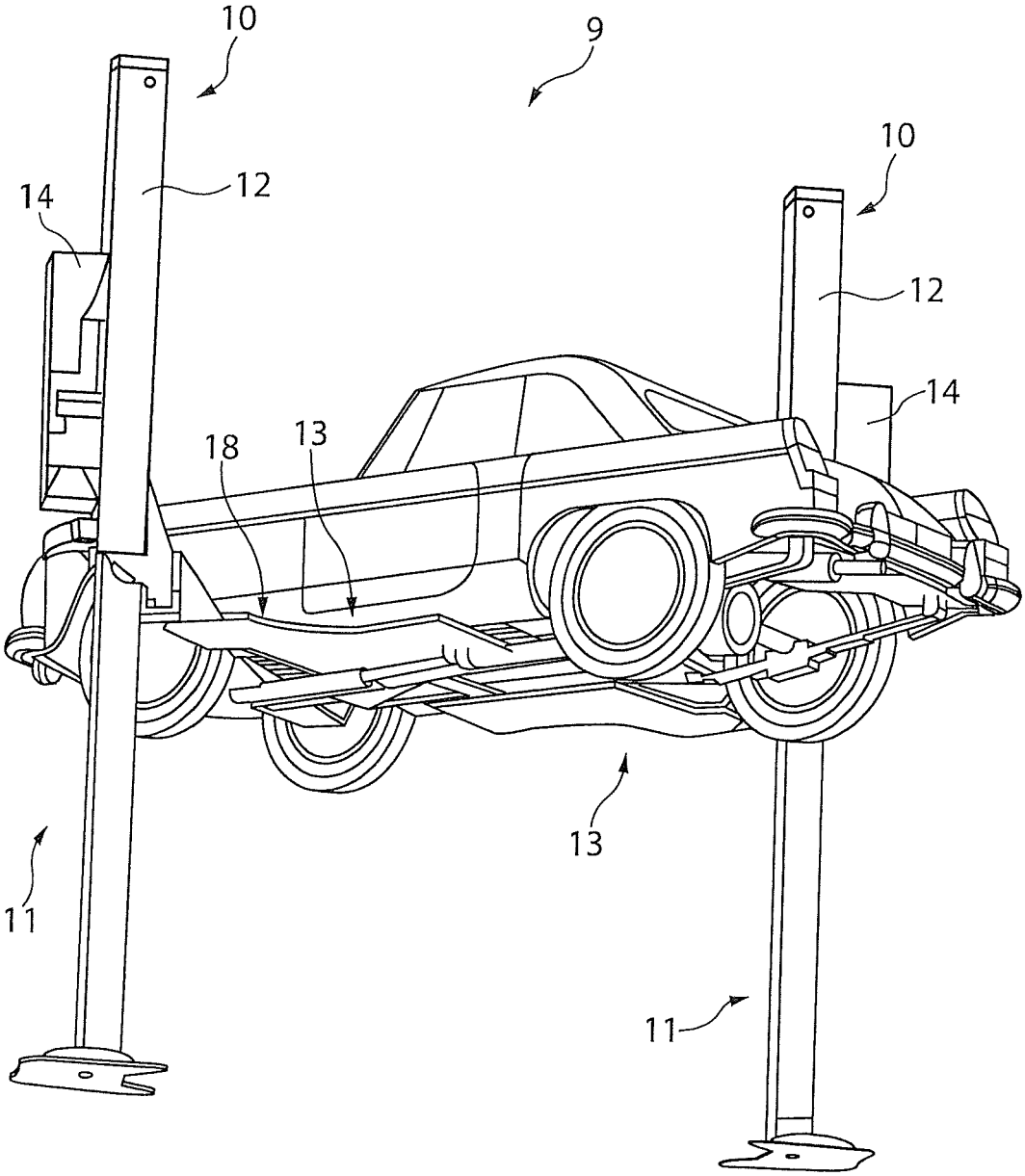

FIG. 12 shows a perspective view onto an alternative embodiment of a lifting platform 9 which is formed by two or a pair of lifting devices 10 which are allocated to each other. For this purpose, preferably two identically-formed lifting devices 12 are provided which are set symmetrically to a mirror axis, which can correspond to a vehicle longitudinal axis. Such an arrangement emerges, for example, in the top view from FIG. 11, wherein in FIG. 11 two pairs of lifting devices 10 which lie opposite each other are provided to form a four-column lifting platform. The orientation of the load receiver 13 as well as the lifting column 11 of the lifting devices 10 are provided accordingly.

The arrangement of a pair of lifting devices 9 which lies opposite each other can also be provided mirror-inverted for the formation of a two-column lifting platform. In this case, the load receivers 13 as well as the orientation of the lifting column 11 of the lifting device 10 are arranged to be mirror-inverted to a longitudinal central axis of the two-column lifting platform or vehicle central axis.

With regard to the alternative arrangement of the pairs of lifting devices 10 which lie opposite each other for a two-column lifting platform, incidentally the embodiments with respect to FIGS. 9 to 11 can be referred to.

What is claimed is:

1. A lifting device to lift and lower loads or vehicles, the lifting device comprising:

a vertical lifting column;

a support arranged on the lifting column which is guided by a guide on the lifting column and is able to be driven vertically along the lifting column;

a drive device configured to lift and lower the support; and a load receiver arranged on the support, wherein the load receiver has a receiving surface configured to be driven over by a vehicle, the receiving surface having a drive-on region, a support region, and a drive-off region which are arranged in a row along a mutual axis in a drive-over direction of the vehicle, wherein the load receiver has a holding arm located outside of the support region, the drive-on region and the drive-off region of the receiving surface, and wherein the receiving surface is configured to support only one wheel or only one dual wheel of a plurality of wheels of the vehicle when the vehicle is in a lowered position and in a lifted position, and the holding arm is arranged in a corner region of the receiving surface for connecting the load receiver to the lifting column, wherein a longitudinal axis of the holding arm is arranged at an acute angle to the axis of the load receiver, wherein an end of the holding arm is arranged on the support of the lifting column and the lifting column is orientated to be offset from the axis of the load receiver and in an angular position relative to the axis of the load receiver, and wherein a fastening device is provided on the holding arm, the fastening device having a flange element arranged on the holding arm, whereby the load receiver is connected releasably to the support.

2. The lifting device according to claim 1, wherein the drive-on region, the support region, the drive-off region and the holding arm of the load receiver are configured to be planar.

3. The lifting device according to claim 1, wherein the load receiver comprises a sandwich construction made from at least two sheet metal layers.

4. The lifting device according to claim 1, wherein the receiving surface is rectangular, quadratic, oval, circular, semi-circular, kidney-shaped or bone-shaped.

5. The lifting device according to claim 1, wherein at least one drive-on aid to drive the vehicle onto the load receiver is provided in the drive-on region and the drive-on aid is arranged pivotable on the load receiver, wherein during lifting of the load receiver from the ground, the drive-on aid is moveable into a securing position in order to secure the wheel on the load receiver.

6. The lifting device according to claim 1, wherein positioning elements are provided on the load receiver to limit the support region, the positioning elements being formed as two longitudinal position sills and being pluggable into the receiving surface of the load receiver in different positions.

7. The lifting device according to claim 1, wherein the support region is enlargeable telescopically along the axis.

8. The lifting device according to claim 1 further comprising a right load receiver and a left load receiver, wherein a first holding arm corresponding to the left load receiver is provided on a left side section of the drive-on or drive-off region and, a second holding arm corresponding to the right load receiver is provided on a right side section of the drive-on region.

9. A lifting platform comprising a plurality of the lifting devices according to claim 1, which are driven by a mutual control, wherein for each axle of the vehicle to be lifted, a pair of the plurality of the lifting devices which lie opposite to each other is provided.

10. The lifting platform according to claim 9 wherein a first pair of the lifting devices includes load receivers having rotary devices provided in the support region and a second pair of the lifting devices having load receivers that are fixed.

11. The lifting platform according to claim 10, wherein the first pair and second pair of the lifting devices each have a right load receiver and a left load receiver such that the lifting columns of the lifting devices stand opposite each other orientated crossways with regard to the orientation thereof.

12. The lifting platform according to claim 9 further comprising a first pair of the lifting devices having a left load receiver and a second pair of the lifting devices having a right load receiver, the first pair of the lifting devices and the second pair of the lifting devices being orientated to mirror symmetrically to the longitudinal axis of a formed work space.

13. The lifting platform according to claim 9 further comprising a first pair of the lifting devices having left load receivers and a second pair of the lifting device having right load receivers, wherein each pair of the lifting devices, which lie opposite each other, has only the right load receivers or the left load receivers.

14. The lifting device according to claim 1, wherein the support region of the load receiver has a recess that enables the support region to be a fixed support region and a steerable support region.

15. The lifting device according to claim 14, wherein the removable cover aligns with the drive-on and drive-off region in a position which closes the recess.

16. The lifting device according to claim 15, wherein the rotary device comprises a rotatable plate which is insertable into the recess in the support region and is received to be rotatable.

17. The lifting device according to claim 14, wherein the recess is sealable with a removable cover on which the only one wheel or only one dual wheel of a plurality of wheels is arranged to be maintained in a fixed position when the support region is a fixed support region, and the recess receives a removable rotary device when the removable cover is removed from the recess, the only one wheel or only one dual wheel of a plurality of wheels being arranged on the rotary device to be steered by the rotary device when the support region is a steerable support region.

18. A lifting device to lift and lower loads or vehicles, the lifting device comprising:

a vertical lifting column;

a support arranged on the lifting column which is guided by a guide on the lifting column and is able to be driven vertically along the lifting column;

a drive device configured to lift and lower the support; and a load receiver arranged on the support, wherein the load receiver has a receiving surface configured to be driven over by a vehicle, the receiving surface having a drive-on region, a support region, and a drive-off region which are arranged in a row along a mutual axis in a drive-over direction of the vehicle, wherein the load receiver has a holding arm located outside of the support region, the drive-on region and the drive-off region of the receiving surface, and wherein the receiving surface is configured to support only one wheel or only one dual wheel of a plurality of wheels of the vehicle when the vehicle is in a lowered position and in a lifted position, and the holding arm is arranged in a corner region of the receiving surface for connecting the load receiver to the lifting column, wherein the support region of the load receiver has a recess that enables the support region to be a fixed support region and a steerable support region, and wherein the recess is sealable with a removable cover on which the only one wheel or only one dual wheel of a plurality of wheels is arranged to be maintained in a fixed position when the support region is a fixed support region, and the recess receives a removable rotary device when the removable cover is removed from the recess, the only one wheel or only one dual wheel of a plurality of wheels being arranged on the rotary device to be steered by the rotary device when the support region is a steerable support region, and wherein positioning elements are provided on the load receiver to limit the support region, the positioning elements being formed as two longitudinal position sills and being pluggable into the receiving surface of the load receiver in different positions.

* * * * *